US010133217B2

(12) United States Patent
Nakatani

(10) Patent No.: US 10,133,217 B2
(45) **Date of Patent: *Nov. 20, 2018**

(54) TRANSFER DEVICE AND IMAGE FORMING APPARATUS

(71) Applicant: Sharp Kabushiki Kaisha, Osaka (JP)

(72) Inventor: Hiroshi Nakatani, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/700,099

(22) Filed: Sep. 9, 2017

(65) Prior Publication Data

US 2017/0371275 A1 Dec. 28, 2017

Related U.S. Application Data

(63) Continuation of application No. 15/285,549, filed on Oct. 5, 2016, now Pat. No. 9,791,809.

(30) Foreign Application Priority Data

Oct. 9, 2015 (JP) ..... 2015-201213
Sep. 5, 2016 (JP) ..... 2016-172777

(51) Int. Cl.
*G03G 15/16* (2006.01)
*G03G 15/00* (2006.01)

(52) U.S. Cl.
CPC ..... *G03G 15/1665* (2013.01); *G03G 15/1605* (2013.01); *G03G 15/6535* (2013.01); *G03G 2215/0132* (2013.01)

(58) Field of Classification Search
CPC ..... G03G 15/1665; G03G 15/1605; G03G 15/6535; G03G 2215/0132
See application file for complete search history.

(56) References Cited

U.S. PATENT DOCUMENTS

| | | | | |
|---|---|---|---|---|
| 5,926,683 | A | 7/1999 | Yuminamochi | |
| 6,266,495 | B1 | 7/2001 | Yuminamochi | |
| 9,791,809 | B2 * | 10/2017 | Nakatani | G03G 15/1665 |
| 2007/0258737 | A1 * | 11/2007 | Ogiyama | G03G 15/1675 399/315 |
| 2011/0229176 | A1 | 9/2011 | Noguchi | |
| 2014/0064761 | A1 | 3/2014 | Hayashi | |

FOREIGN PATENT DOCUMENTS

JP 10-090974 A 4/1998

OTHER PUBLICATIONS

Allowed claims from Co-Pending Parent U.S. Appl. No. 15/285,549.

* cited by examiner

*Primary Examiner* — Sandra Brase
(74) *Attorney, Agent, or Firm* — Renner, Otto, Boisselle & Sklar, LLP

(57) ABSTRACT

A transfer device includes a transfer roller, a stripping electrode, and a protective member. The transfer roller transfers a toner image formed on an image bearing member to a sheet in a transfer position. The stripping electrode is arranged downstream from the transfer position to which the sheet is to be carried. The stripping electrode includes a plurality of needle electrodes. The protective member is arranged on the transfer roller side with respect to the stripping electrode and overlaid on the stripping electrode. The protective member includes a cutout provided in a position facing at least one of the needle electrodes.

7 Claims, 8 Drawing Sheets

TRANSFER DEVICE AND IMAGE FORMING APPARATUS

CROSS REFERENCE

This Nonprovisional application claims priority under 35 U.S.C. § 119(a) on Patent Application No. 2015-201213 filed in Japan on Oct. 9, 2015, and Patent Application No. 2016-172777 filed in Japan on Sep. 5, 2016, each of the entire contents of which are hereby incorporated by reference.

BACKGROUND OF THE INVENTION

1. Field of the Invention

This invention relates to a transfer device that transfers a toner image formed on an image bearing member to a sheet, and an image forming apparatus including the transfer device.

2. Description of Related Art

In one image forming apparatus, a toner image formed on a photoreceptor drum is transferred to a sheet. In another image forming apparatus, a toner image formed on a photoreceptor drum is transferred primarily to an intermediate transfer belt and the toner image is transferred secondarily to a sheet from the intermediate transfer belt. The sheet including the transferred toner image is carried to a fixing device via a transfer position for the toner image. At this time, it is very likely that the sheet will be drawn toward an image bearing member such as a photoreceptor or an intermediate transfer belt, etc. by the action of electrostatic force generated in the sheet. Hence, a technique of stripping the sheet including the transferred toner image from the image bearing member has conventionally been suggested.

According to one exemplary technique, an electric field is formed on the opposite side of an image bearing member across a sheet to strip the sheet electrically. This technique is implemented by using a sawtooth electrode employed in a corona charging device described in Japanese published unexamined patent application No. 10-90974 (1998), for example.

The sawtooth electrode has a sharply pointed tip at each saw tooth. This causes risk of deformation of the sawtooth electrode due to touch with the sawtooth electrode by a sheet during carrying of the sheet or touch with the sawtooth electrode by a user or a repairman during maintenance. Deformation of the sawtooth electrode causes risk of interfering with formation of an electric field intended for stripping of a sheet. If a sufficient electric field is not formed, a sheet wraps around an image bearing member before being carried to a fixing device and this becomes a cause for a paper jam.

SUMMARY OF THE INVENTION

A transfer device according to this invention includes a transfer roller, a stripping electrode, and a protective member. The transfer roller transfers a toner image formed on an image bearing member to a sheet in a transfer position. The stripping electrode is arranged downstream from the transfer position to which the sheet is to be carried. The stripping electrode includes a plurality of needle electrodes. The protective member is arranged on the transfer roller side with respect to the stripping electrode and overlaid on the stripping electrode. The protective member includes a cutout provided in a position facing at least one of the needle electrodes.

DETAILED DESCRIPTION OF THE EMBODIMENTS

[1] First Embodiment

[1-1] Outline of Image Forming Apparatus

Figure 1:
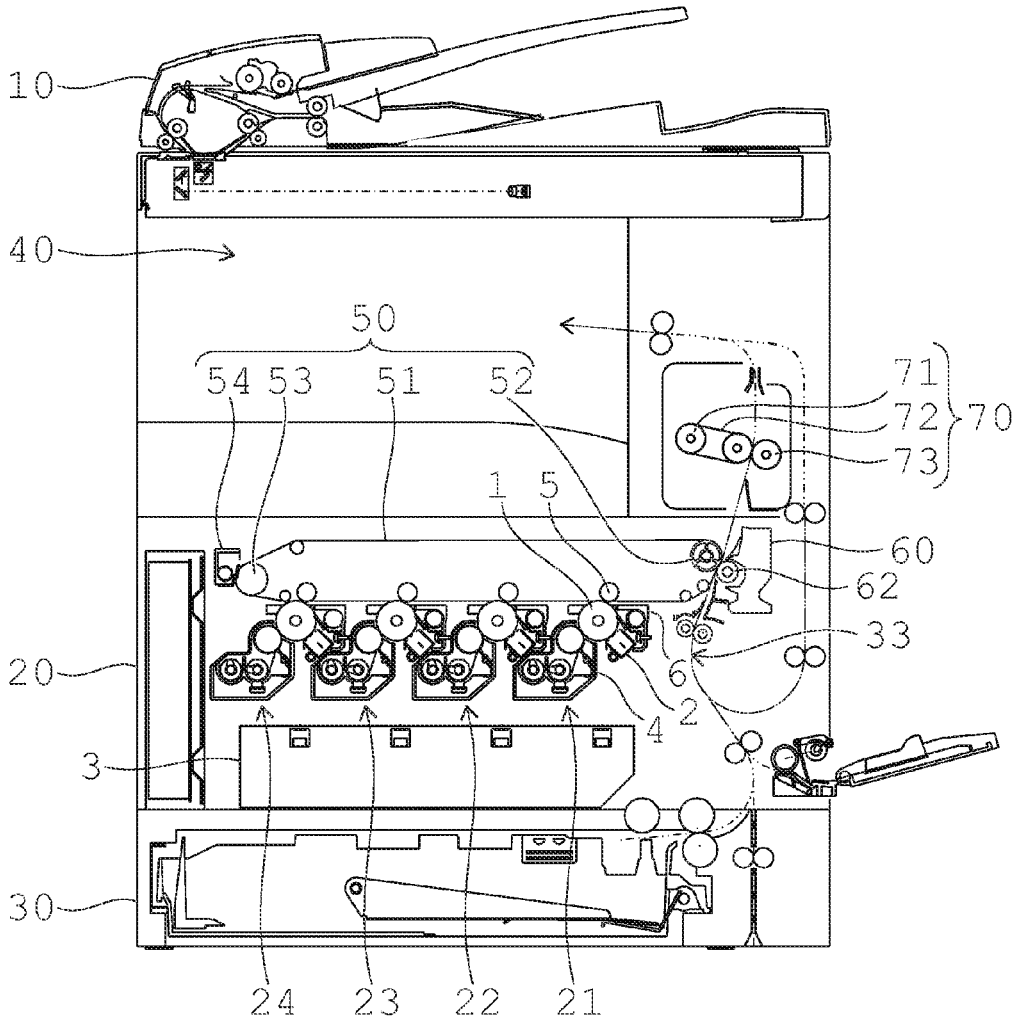
FIG. 1 shows the structure of an image forming apparatus in outline according to a first embodiment.

As shown in FIG. 1, the image forming apparatus includes an image reading portion 10, an image forming portion 20, a sheet feed portion 30, and a sheet output portion 40. The image reading portion 10 reads an image of a document and generates image data based on the read image. The image forming portion 20 performs image forming processing based on the image data to make a print on a sheet fed from the sheet feed portion 30. The sheet with the print is output to the sheet output portion 40.

The image forming apparatus includes a carriage path 33 for carriage of a sheet fed from the sheet feed portion 30 to the sheet output portion 40. More specifically, the carriage path 33 extends from the sheet feed portion 30 to the sheet output portion 40 via a secondary transfer position and a fixing position described later. The image forming apparatus may include a different carriage path for any purpose such as a carriage path for duplex printing.

The image forming portion 20 includes four image forming stations 21 to 24, an exposure unit 3, an intermediate transfer device 50, a secondary transfer device 60, and a fixing device 70. The image forming stations 21 to 24 are arranged in a line in a direction in which an intermediate transfer belt 51 rotates. The image forming stations 21 to 24 form toner images in four colors including black, cyan, magenta, and yellow respectively based on image data.

Each of the image forming stations 21 to 24 includes a photoreceptor drum 1, a charging unit 2, a developing unit 4, an intermediate roller 5, and a cleaner unit 6. The photoreceptor drum 1 is an electrostatic latent image bearing member. In response to receipt of driving force transmitted from a driving source (not shown in the drawings), the photoreceptor drum 1 rotates in a given direction. The charging unit 2 charges the circumferential surface of the photoreceptor drum 1 in such a manner that the circumferential surface is placed at a given potential. The exposure unit 3 irradiates the photoreceptor drum 1 of each of the image forming stations 21 to 24 with a laser beam modulated based on image data of the phase of a corresponding one of the four colors (black, cyan, magenta, and yellow). In this way, an electrostatic latent image is formed on the circumferential surface of each photoreceptor drum 1 based on the image data of a corresponding color phase. Then, toner is fed from the developing unit 4 to this circumferential surface, thereby developing the electrostatic latent image into a toner image.

The intermediate transfer device 50 includes the intermediate transfer belt 51 (corresponding to an "image bearing member" described in the appended claims), a drive roller 52 that drives the intermediate transfer belt 51, and a support roller 53 that supports the intermediate transfer belt 51 together with the drive roller 52. The drive roller 52 and the support roller 53 are arranged parallel to each other. The intermediate transfer belt 51 is tightly stretched in a loop pattern around the drive roller 52 and the support roller 53. More specifically, the intermediate transfer belt 51 is tightly stretched around the drive roller 52 and the support roller 53 in such a manner that the outer surface of the intermediate transfer belt 51 faces the photoreceptor drums 1 of the corresponding image forming stations 21 to 24 in order during rotation of the intermediate transfer belt 51.

The intermediate rollers 5 are arranged in positions facing the corresponding photoreceptor drums 1 across the intermediate transfer belt 51. For transfer of toner images to the intermediate transfer belt 51 from the corresponding four photoreceptor drums 1 (primary transfer), a primary transfer bias of polarity (in this embodiment, positive) opposite the charging polarity of toner (in this embodiment, negative) is applied to the intermediate rollers 5. Constant voltage control is executed during this bias application. The toner images are transferred in order in primary transfer positions facing the corresponding four photoreceptor drums 1 to the intermediate transfer belt 51 to overlap each other, thereby forming a full-color toner image on the outer surface of the intermediate transfer belt 51 (primary transfer).

In response to the rotation of the intermediate transfer belt 51, the toner image formed on the intermediate transfer belt 51 is carried to the secondary transfer position where the toner image is to be transferred to a sheet by the secondary transfer device 60. In this embodiment, a secondary transfer roller 62 in the secondary transfer device 60 is arranged in a position facing the drive roller 52 across the intermediate transfer belt 51 and the secondary transfer roller 62 contacts the outer surface of the intermediate transfer belt 51 under given pressure. The secondary transfer position is a position on the drive roller 52 determined on the rotation path of the intermediate transfer belt 51. The secondary transfer roller 62 is grounded for example via a conductive bearing or a contact electrode (not shown in the drawings) connected to the core (shaft) of the secondary transfer roller 62 (see FIG. 5). The secondary transfer device 60 will be described in detail later.

Figure 5:
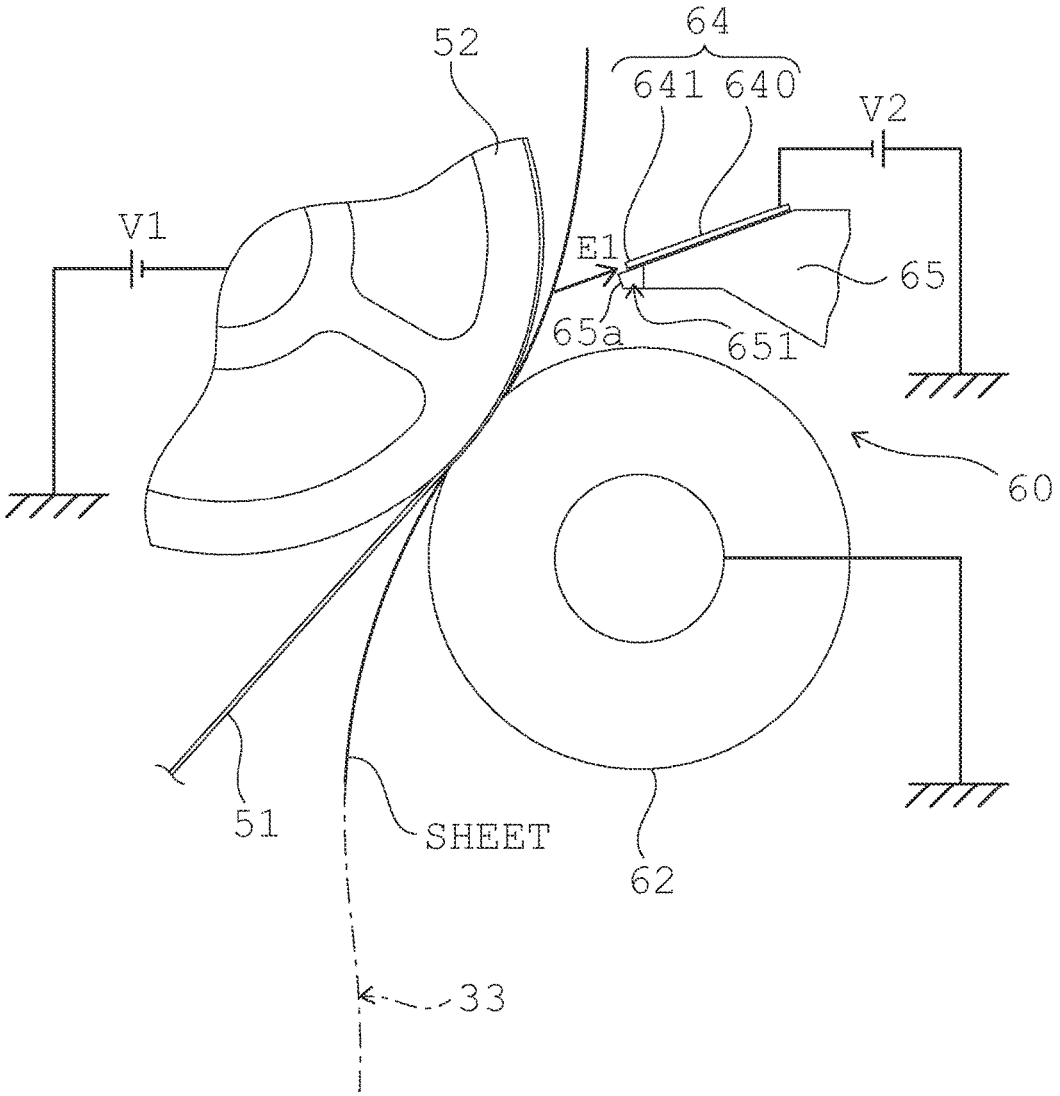
FIG. 5 is an explanatory view about application of a voltage to each portion and an electric field formed in the vicinity of a secondary transfer position.

For transfer of the toner image to a sheet from the intermediate transfer belt 51 (secondary transfer), a secondary transfer bias V1 of polarity (in this embodiment, negative) same as the charging polarity of toner is applied to the drive roller (see FIG. 5). Constant current control is executed during this bias application to cause a secondary transfer current to flow from the secondary transfer roller 62 to the drive roller 52 via the sheet and the intermediate transfer belt 51. In this way, the full-color toner image born on the outer surface of the intermediate transfer belt 51 is transferred to the sheet in the secondary transfer position. After the secondary transfer, the toner remaining on the intermediate transfer belt 51 is recovered by a cleaning unit 54 (see FIG. 1).

The sheet including the transferred toner image is carried to the fixing device 70. The fixing device 70 includes a heating roller 71, a fixing belt 72 heated by the heating roller 71, and a pressure roller 73 contacting the fixing belt 72 under pressure in the fixing position. By passing the sheet through the fixing position, the sheet is heated and pressurized to transfer the toner image to the sheet fixedly.

In the aforementioned image forming apparatus, a sheet to pass through the secondary transfer position is charged to polarity (in this embodiment, positive) opposite the charging polarity of toner by the action of the secondary transfer current flowing from the secondary transfer roller 62 into the drive roller 52 via the sheet. Further, it is very likely that the sheet will be drawn toward the intermediate transfer belt 51. Hence, in the absence of any countermeasure, the sheet wraps around the intermediate transfer belt 51 before being carried to the fixing device 70 and this becomes a cause for a paper jam. Then, the structure of the secondary transfer device 60 of this embodiment is devised as follows.

[1-2] Secondary Transfer Device

Figure 2:
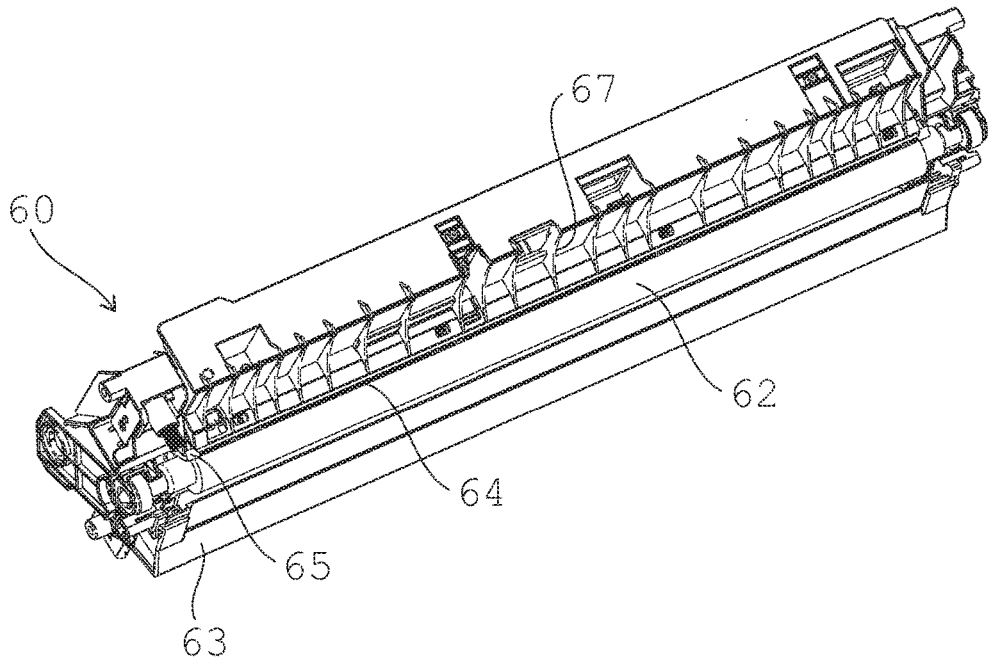
FIG. 2 is a perspective view showing a secondary transfer device in the image forming apparatus.
Figure 3A:
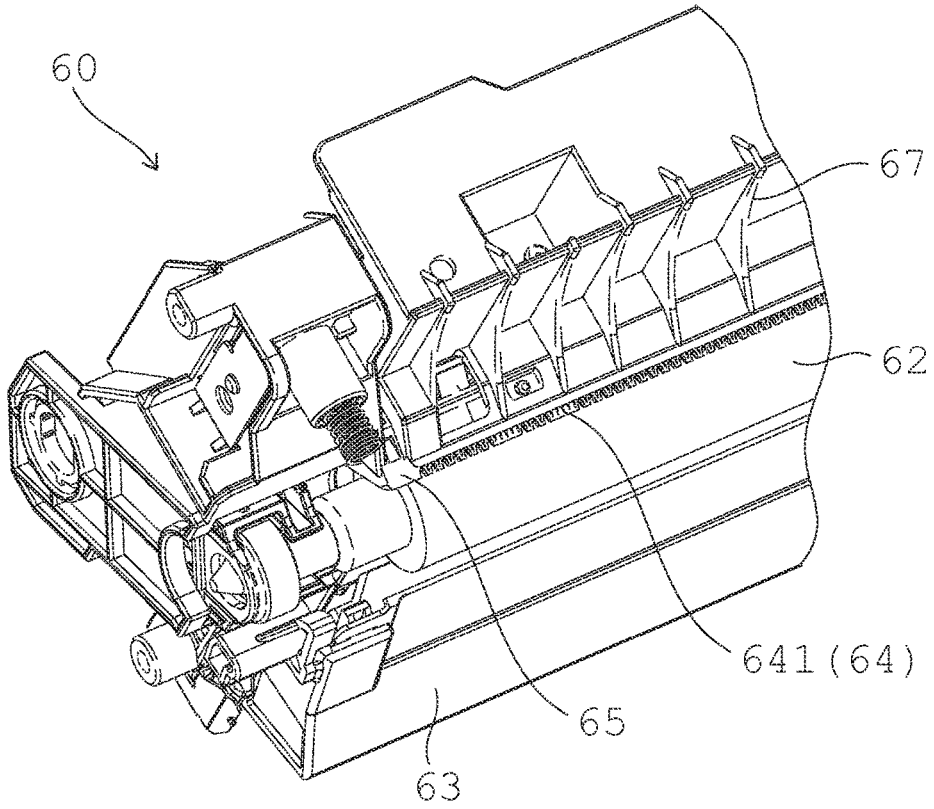
FIG. 3A is an enlarged perspective view showing a principal section of the secondary transfer device.
Figure 3B:
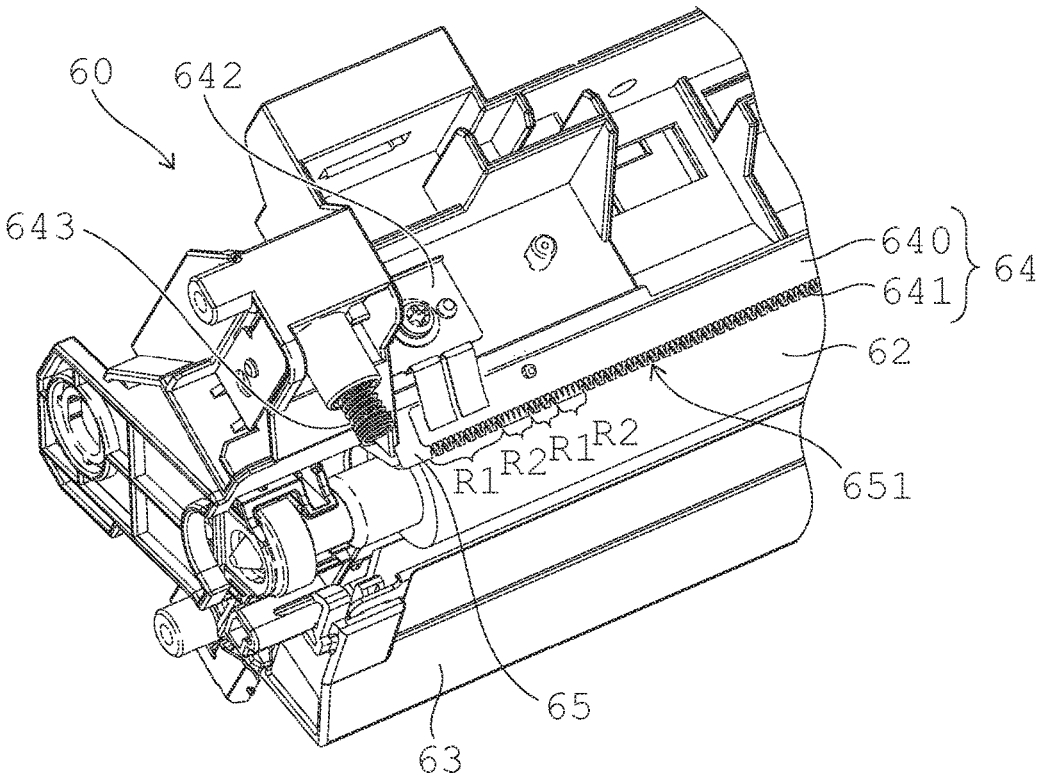
FIG. 3B is an enlarged perspective view showing the principal section without a paper guide portion.

As shown in FIGS. 2 to 3B, the secondary transfer device 60 includes a frame 63, a stripping electrode 64, a protective member 65, and a paper guide portion 67 in addition to the secondary transfer roller 62.

The frame 63 is a member for unitizing the structures of the secondary transfer device 60. The secondary transfer roller 62 is rotatably supported by the frame 63. The protective member 65 and the paper guide portion 67 are fixed to the frame 63. The protective member 65 and the paper guide portion 67 are arranged in this order downstream from the secondary transfer position to which a sheet is carried. The frame 63 is formed by using various types of resin suitable for molding such as polycarbonate/ABS resin. At least one of the protective member 65 and the paper guide portion 67 may be formed integrally with the frame 63.

The stripping electrode 64 is arranged downstream from the secondary transfer position and held on a surface of the protective member 65 opposite a surface thereof close to the secondary transfer roller 62. The stripping electrode 64 includes a base portion 640 and a plurality of needle electrodes 641 protruding from the base portion 640 (see FIG. 3B). More specifically, the base portion 640 is held by the protective member 65 while extending in a direction agreeing with a rotation axis of the secondary transfer roller 62 (agreeing with the longitudinal direction of the secondary transfer roller 62). The needle electrodes 641 are provided at an edge 640*a* of the base portion 640 close to the carriage path 33 of a sheet (close to the intermediate transfer belt 51) and protrude from the edge 640*a* toward the carriage path 33 (see FIGS. 4A and 5).

In this embodiment, the base portion 640 has a length substantially the same as the length of the secondary transfer roller 62. The needle electrodes 641 are arranged at given intervals through the edge 640*a* of the base portion 640 entirely. It is preferable that each needle electrode 641 have a length L from about 1.5 to about 2 mm. By setting the length L in such a range, the tip of each needle electrode 641 can be separated from the base portion 640. This allows an electric field to be concentrated at the tip of each needle electrode 641 easily.

The base portion 640 of the stripping electrode 64 is electrically connected to a connection electrode plate 642

(see FIG. 3B). The connection electrode plate 642 is connected to a coil 643 as a contact terminal. By connecting the coil 643 to an electrode high-voltage power source (not shown in the drawings) installed on the image forming apparatus via a connection terminal (not shown in the drawings), a given voltage V2 (in this embodiment, from about −2 to about −3 kV) is applied to the stripping electrode 64 via the coil 643 and the connection electrode plate 642 under the constant voltage control (see FIG. 5).

The protective member 65 is arranged on the secondary transfer roller 62 side with respect to the stripping electrode 64 and overlaid on the stripping electrode 64. More specifically, the protective member 65 includes a front edge 65*a* arranged close to the carriage path 33 and the front edge 65*a* juts out further toward the carriage path 33 than any of the needle electrodes 641 (see FIGS. 4A to 5).

Figure 4A:
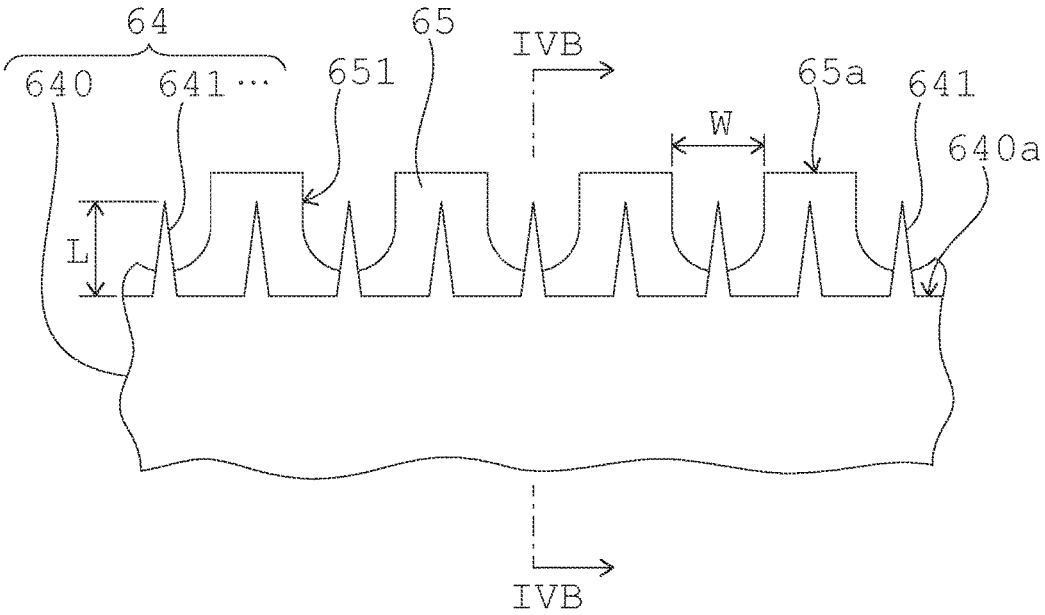
FIG. 4A is a plan view showing a stripping electrode and a protective member in the secondary transfer device.
Figure 4B:
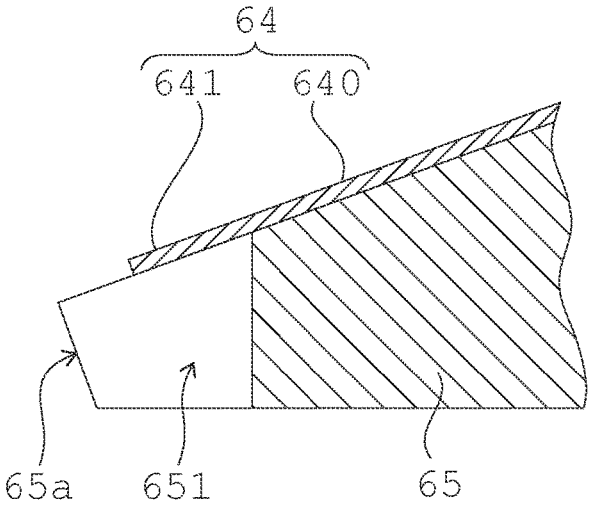
FIG. 4B is a sectional view taken along a line IVB-IVB of FIG. 4A.

As shown in FIGS. 4A and 4B, the protective member 65 includes a cutout 651 provided in a position facing every other one of the needle electrodes 641. More specifically, the cutout 651 has a shape defined by recessing a part of the front edge 65*a* of the protective member 65 in a U-shape. Thus, in a view of the protective member 65 taken from the stripping electrode 64 side, the tip of the needle electrode 641 corresponding to the cutout 651 is arranged inside the cutout 651. An opening width W of the cutout 651 at the front edge 65*a* is preferably from about 1 to about 2 mm, more preferably, about 1 mm. The shape of the cutout 651 is not limited to a U-shape but it can be changed to various recessed shapes such as a V-shape and an angular-groove shape.

According to the structure of the first embodiment, a constant voltage is applied to the stripping electrode 64 in such a manner as to place the stripping electrode 64 in polarity opposite the charging polarity of a sheet (in this embodiment, positive). By doing so, a concentrated electric field starting from the tip of the needle electrode 641 is formed as a stripping electric field E1 for stripping of a sheet (see FIG. 5). In the secondary transfer device 60, the protective member 65 includes the cutout 651 provided in a position facing the needle electrode 641. Thus, the needle electrode 641 corresponding to the cutout 651 is not overlaid on the protective member 65, so that the stripping electric field E1 formed to start from the tip of this needle electrode 641 is allowed to act efficiently on a sheet. In this way, the sheet being carried via the secondary transfer position can be stripped efficiently from the intermediate transfer belt 51 against electrostatic force acting to draw the sheet toward the intermediate transfer belt 51 (image bearing member).

The cutout 651 is provided partially to the protective member 65 in a position facing the needle electrode 641 while the protective member 65 is overlaid on the stripping electrode 64. Thus, while the needle electrode 641 corresponding to this cutout 651 is not overlaid on the protective member 65, this needle electrode 641 is protected by an edge of the protective member 65 forming the cutout 651. More specifically, in a view of the protective member 65 taken from the stripping electrode side, the tip of the needle electrode 641 corresponding to the cutout 651 is arranged inside the cutout 651 (see FIG. 4A). Thus, the tip of the needle electrode 641 can be protected from contact with a sheet or a user, for example. As a result, deformation of the needle electrode 641 is prevented, so that a favorable condition is achieved in terms of stripping of a sheet from the intermediate transfer belt 51 (image bearing member).

[2] Second Embodiment

As shown in FIG. 3B, a first region R1 in the protective member 65 is a region where the cutout 651 is provided to correspond to every other one of the needle electrodes 641. The first region R1 does not necessarily occupy the entire range of the protective member 65 in the longitudinal direction thereof but a second region R2 described below different from the first region R1 may further be provided. In the second region R2, the protective member 65 does not include the cutout 651, so that the protective member 65 is overlaid on successive two or more needle electrodes 641 entirely. Thus, in the second region R2, the needle electrode 641 does not protrude from the protective member 65. In this way, the tip of the needle electrode 641 is protected by the protective member 65, while action of a concentrated electric field formed at the tip of this needle electrode 641 on a sheet is reduced.

The second region R2 may include a plurality of second regions R2 arranged in the longitudinal direction of the protective member 65. The width of the second region R2 in the longitudinal direction of the protective member 65 may be adjusted. A desirable distribution (distribution with desirable intensities) of the stripping electric field E1 can be formed in the longitudinal direction of the protective member 65, by making at least one of the following adjustments in the longitudinal direction of the protective member 65: an adjustment of arrangement of the first region R1 and the second region R2; and an adjustment of the width of the second region R2. This makes it possible to determine one or a plurality of points properly (points where the intensity of the stripping electric field E1 is high) in the longitudinal direction of the protective member 65 where stripping is to start. As a result, a more favorable condition is achieved in terms of stripping of a sheet from the intermediate transfer belt 51 (image bearing member).

Thus, the following preferred embodiment may be devised. Specifically, the first region R1 can be formed in a region of the protective member 65 to face each of opposite lateral end portions of a sheet where the sheet is likely to wrap around the intermediate transfer belt 51, and the second region R2 can be formed in the other region of the protective member 65. In response to various sizes of sheets to pass along the carriage path 33, the first region R1 may be provided in each of regions responsive to opposite end portions of sheets of various sizes. The first region R1 may also be provided in a central region of the protective member 65 in the longitudinal direction thereof (region to face a central portion of a sheet). This facilitates stripping of the sheet in its entirety, so that the sheet can be output from the secondary transfer position in a stable direction.

According to the structure of the second embodiment, provision of the needle electrode 641 exposed by the cutout 651 can be concentrated in a region (first region R1) to face each of opposite lateral end portions of a sheet where the sheet is likely to wrap around the intermediate transfer belt 51. This allows concentration of the stripping electric field E1 at the opposite lateral end portions of the sheet. As a result, the sheet can be stripped from the intermediate transfer belt 51 more efficiently.

[3] Third Embodiment

Figure 6:
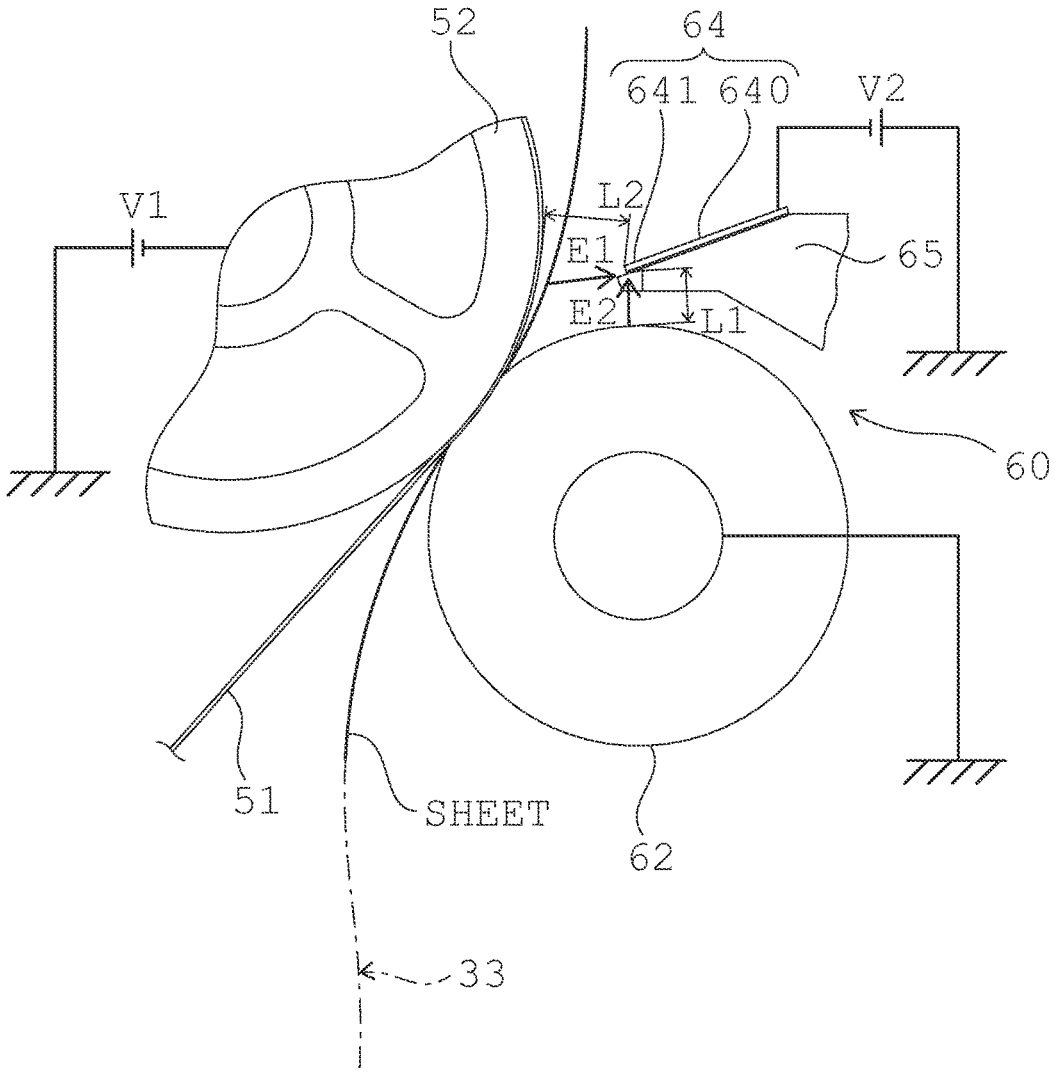
FIG. 6 is an explanatory view about an electric field formed in the vicinity of a secondary transfer position according to a third embodiment.

As shown in FIG. 6, it is preferable that the needle electrode 641 of the stripping electrode 64 be arranged adjacent to the secondary transfer roller 62. More specifically, it is preferable that the stripping electrode 64 be arranged in such a manner that a shortest distance L1 from the tip of the needle electrode 641 to the secondary transfer roller 62 be smaller than a shortest distance L2 from the tip of the needle electrode 641 to the drive roller 52.

According to the structure of the third embodiment, a new electric field (second stripping electric field E2) different from the stripping electric field E1 described in the first embodiment can be formed between the tip of the needle electrode 641 and the secondary transfer roller 62. This allows the stripping electric field E2 to act on a sheet in a position closer to the secondary transfer position. As a result, the sheet can be stripped more efficiently from the intermediate transfer belt 51.

[4] Fourth Embodiment

Figure 7:
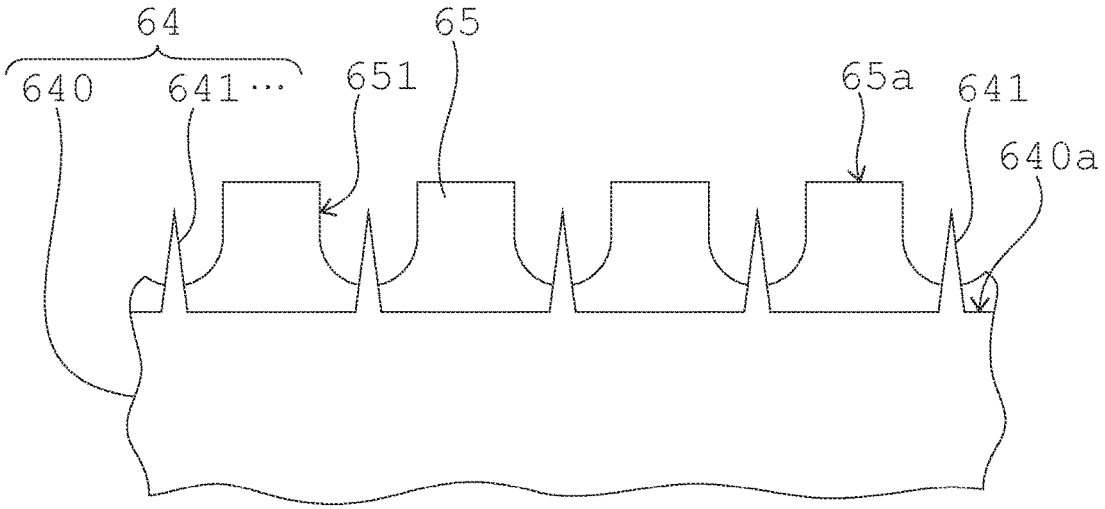
FIG. 7 is a plan view showing a different example of the stripping electrode and a different example of the protective member described in a fourth embodiment.

As shown in FIG. 7, the protective member 65 may include the cutout 651 provided in a one-to-one relationship with each of the needle electrodes 641. According to this structure, a concentrated electric field (stripping electric field E1) formed at the tip of each of the needle electrodes 641 is allowed to act on a sheet efficiently without being wasted.

The structure of the protective member 65 is not limited to those described in the aforementioned embodiments but can be changed to various structures where the cutout 651 is provided in a position facing at least one of the needle electrodes 641.

[5] Fifth Embodiment

Each structure of the image forming apparatus described in the aforementioned embodiments is also applicable to an image forming apparatus where the secondary transfer device 60 further includes a secondary transfer belt interposed between the intermediate transfer belt 51 and the secondary transfer roller 62. In this secondary transfer device 60, the stripping electrode 64 is arranged in a position close to the inner surface of the secondary transfer belt (opposite the carriage path 33 of a sheet). This structure also allows the stripping electric field E1 formed at the tip of the needle electrode 641 of the stripping electrode 64 to act on a sheet.

Each structure of the image forming apparatus described in the aforementioned embodiments is also applicable to efficient stripping of a sheet from the photoreceptor drum 1 in an image forming apparatus where a toner image is to be transferred to the sheet in a primary transfer position.

It should be noted that the foregoing description of the embodiment is in all aspects illustrative and not restrictive. The scope of this invention is defined by the appended claims rather than by the embodiment described above. All changes that fall within a meaning and a range equivalent to the scope of the claims are therefore intended to be embraced by the claims.

What is claimed is:

1. A transfer device comprising:

a transfer roller that transfers a toner image formed on an image bearing member to a sheet in a transfer position;

a stripping electrode arranged downstream from the transfer position to which the sheet is to be carried, the stripping electrode including a base portion and a plurality of needle electrodes protruding from the base portion; and a protective member arranged on the transfer roller side with respect to the stripping electrode and overlaid on the stripping electrode, the protective member including a cutout provided in a position facing at least one of the needle electrodes.

2. The transfer device according to claim 1, wherein a tip of each of the needle electrodes is arranged in a position closer to the transfer roller than to the base portion.

3. The transfer device according to claim 2, wherein the needle electrodes protrude from the base portion toward a carriage path along which the sheet is to be carried.

4. The transfer device according to claim 1, wherein a tip of the needle electrode corresponding to the cutout is exposed inside the cutout.

5. The transfer device according to claim 4, wherein the cutout has a recessed shape.

6. The transfer device according to claim 1, wherein a voltage is applied to the stripping electrode in such a manner as to place the stripping electrode in polarity opposite the charging polarity of the sheet.

7. The transfer device according to claim 6, wherein the transfer roller is grounded, and the stripping electrode is arranged adjacent to the transfer roller.

* * * * *